US006245157B1

(12) United States Patent
Gerlach et al.

(10) Patent No.: US 6,245,157 B1
(45) **Date of Patent: *Jun. 12, 2001**

(54) USE OF POLYASPARTIC ACIDS IN CLEANER FORMULATIONS WITH ABRASIVE ACTION

(75) Inventors: Manfred Gerlach, Leverkusen; Bernhard Lehmann, Aachen; Hartwig Wendt, Köln; Herbert Emde, Leverkusen; Urban Recht, Köln, all of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/395,645

(22) Filed: Sep. 14, 1999

(30) Foreign Application Priority Data

Sep. 15, 1998 (DE) ..... 19842053

(51) Int. Cl.[7] ..... C23G 1/02

(52) U.S. Cl. ..... 134/7; 134/6; 134/22.1; 134/22.17; 134/22.18; 134/22.19; 134/24; 134/36; 134/40; 134/42; 134/38; 510/108; 510/245; 510/253; 510/434; 510/477; 510/478; 510/509; 451/39; 451/40

(58) Field of Search ..... 134/6, 7, 22.1, 134/22.17, 22.18, 22.19, 34, 36, 40, 42, 38; 510/108, 245, 253, 434, 477, 478, 509; 451/39, 40

(56) References Cited

U.S. PATENT DOCUMENTS

| | | | | |
|---|---|---|---|---|
| 4,521,332 | * | 6/1985 | Milora | 252/527 |
| 4,817,312 | | 4/1989 | Fuller et al. | 40/439 |
| 4,817,342 | | 4/1989 | Martin et al. | 51/439 |
| 5,081,799 | | 1/1992 | Kirschner et al. | 51/410 |
| 5,083,402 | | 1/1992 | Kirschner et al. | 51/319 |
| 5,160,547 | * | 11/1992 | Kirschner et al. | 134/7 |
| 5,487,695 | | 1/1996 | Shank | 45/102 |
| 5,505,749 | * | 4/1996 | Kirschner et al. | 51/309 |
| 5,512,071 | | 4/1996 | Yam et al. | 51/307 |
| 5,643,863 | * | 7/1997 | Guerin et al. | 510/466 |
| 5,679,761 | | 10/1997 | Heuer et al. | 528/363 |
| 5,756,447 | * | 5/1998 | Hall | 510/475 |
| 5,770,553 | * | 6/1998 | Kroner et al. | 510/360 |
| 5,851,970 | * | 12/1998 | Saito et al. | 510/181 |
| 5,909,745 | * | 6/1999 | Ali et al. | 134/42 |
| 5,935,920 | * | 8/1999 | Geke et al. | 510/245 |

FOREIGN PATENT DOCUMENTS

| | | |
|---|---|---|
| 4310995 | 10/1995 | (DE) . |
| 561452 | 9/1993 | (EP) . |
| 644257 | 3/1995 | (EP) . |
| 2106734 | 5/1972 | (FR) . |
| 91/15308 | 10/1991 | (WO) . |

* cited by examiner

*Primary Examiner*—Sharidan Carrillo
(74) *Attorney, Agent, or Firm*—Joseph C. Gil; Diderico van Eyl

(57) ABSTRACT

The present invention relates to cleaning compositions which, as powder or as aqueous formulation, comprise sodium bicarbonate and, as dispersants, polyaspartic acids and/or salts thereof, to the use of these cleaning compositions for the abrasive cleaning of hard surfaces, and also to a method of cleaning surfaces contaminated with deposits using these cleaning compositions.

12 Claims, No Drawings

USE OF POLYASPARTIC ACIDS IN CLEANER FORMULATIONS WITH ABRASIVE ACTION

FIELD OF THE INVENTION

The present invention relates to cleaning compositions which, as powder or as aqueous formulation, comprise sodium bicarbonate and, as dispersant, polyaspartic acid and/or salts thereof, to the use of these cleaning compositions for the abrasive cleaning of hard surfaces, and also to a method of cleaning surfaces contaminated with deposits using these cleaning compositions.

BACKGROUND OF THE INVENTION

It is state of the art to clean hard surfaces such as metal or non-metallic surfaces, e.g., building walls or ceramics, with abrasive agents. This is carried out for reasons of hygiene or in order to prepare surfaces for a protective coating. The aim of the cleaning composition is to remove, from metallic and non-metallic surfaces, the mineral, vegetable and animal oils, fats, waxes and soiling and other inorganic and organic compounds and salts, such as ash, powders, granules, dusts, pigments, fillers, soot, tar, organic polymers and the like which adhere thereto.

Cold cleaners are used to detach contaminants of the above-mentioned type from hard surfaces and to transfer them into the aqueous phase. Requirements placed on environmentally-friendly cold cleaners of the first generation were rapid dissolution and detachment of the soiling and rapid separation of the oil and solvent phase from the aqueous phase and low solubility in water of surfactants, emulsifiers and solvents. The second generation, the group of rapidly separating cold cleaners, is based on surfactants or surfactant mixtures which form coarsely disperse water-in-oil emulsions which also break down relatively quickly. Environmentally friendly cold cleaners of the third generation use organic salts, which, because of their chemical structure, have a high affinity towards hard surfaces. Layers of soiling are undermined over their whole area, resulting in virtually complete removal of the soiling upon subsequent cleaning with water. The effectiveness of a cleaning composition is determined by its ability to wet and penetrate soiled surfaces, and thus to promote solubilization and dispersion.

The ability of a cleaning composition to be effective is thus a combination of a number of effects, namely lowering of the interfacial tension between an aqueous and an oily phase and influence of the interaction between particles and wash liquor as a result of penetration and salvation, association, absorption and hydration.

The technical solution to this problem usually involves using processes which spray abrasive cleaning compositions under high pressure. This can be carried out using an aqueous solution, suspension and dispersion of the cleaning composition or a suitable mixture of cleaning compositions with or without carriers. Also known, from U.S. Pat. No. 4,817,312, incorporated herein by reference in its entirety, are dry processes, i.e., processes which use compressed air, or combinations of dry ("sandblasting") and wet blasting techniques.

In low-pressure processes of U.S. Pat. No. 5,487,695, incorporated herein by reference in its entirety, the formation of large amounts of dust is avoided by mixing water and compressed air in the nozzle and so limiting the formation of soiling during use by means of a particular nozzle technology.

A frequently used method for the abrasive cleaning of surfaces is the sandblasting method. Sand is a very hard abrasive material which can be used effectively for removing paint or encrustations on metallic surfaces, such as steel. Although silicates are very useful for all types of abrasive blasting techniques, they also have some serious disadvantages.

A health risk for an operator is that microcrystalline silicate fractions which form as a result of silicate crystals being crushed on the surface to be cleaned can pass into the lungs and thus lead to serious health problems. In particular, the expenditure for cleaning the surrounding area when sandblasting is complete must be taken into account. For many surfaces, sand is too hard a material which permanently damages the structure of the surfaces to be cleaned, for example, in the case of aluminum, plastics surfaces or wood. In the industrial sector, sand can enter machinery and can permanently damage engines and mechanisms.

For this reason, pressurized jet cleaning using sodium bicarbonate has been developed as an alternative to the silicate process. U.S. Pat. No. 5,081,799, incorporated herein by reference in its entirety, and U.S. Pat. No. 5,083,402, incorporated herein by reference in its entirety, disclose the use of abrasive agents instead of sand, such as sodium chloride or sodium bicarbonate. Sodium bicarbonate is usually blasted onto the area to be cleaned at superatmospheric pressure with or without the addition of water. Here, the sodium bicarbonate crystals clean, firstly, in an abrasive manner, i.e., physically. Secondly, they provide a chemical cleaning power since, as a result of their alkalinity, they are also able to attack in a chemical manner and hydrolyse. It is likewise possible to use $SiO_2$-hydrophobicized particles (WO 91/15 308, incorporated herein by reference in its entirety) of inorganic salts, which significantly reduce the hygroscopicity of many salts and thus permit better industrial application because clumping in the high-pressure plant is largely suppressed. Sodium bicarbonate is not harmful to the environment and is readily soluble in water, meaning that any crystalline particles which remain can be washed away with water (U.S. Pat. No. 5,487,695, incorporated herein by reference in its entirety).

A common characteristic of all of the processes described in the prior art and established in practice is that, irrespective of how the abrasive cleaning of surfaces is carried out in technical terms and irrespective of the abrasive materials and cleaning compositions used therefor, they must always be followed by a second, labor-intensive cleaning process. This shortcoming means that the soiling which has been removed and the spent cleaning composition must be cleaned away together, or sedimented solids must be collected and disposed of by other suitable measures. It is thus considerably time-consuming and costly to likewise have to post-treat and clean the area directly surrounding the cleaned area.

The object of the present invention was thus to undermine, dissolve, detach or rub down deposits of the above type using suitable cleaning compositions, and to disperse and stabilize the soiling in an iso- and a polydisperse manner, as finely as possible, in the wash liquor. The aim in particular was to largely suppress sedimentation processes in the wash liquor in order to be able to dispose of the liquor with as high a soiling content as possible directly in an environmentally friendly manner, thus satisfying the desired application requirements with regard to dispersibility of the waste water. In this way, the expenditure on post-treatment and cleaning of the surroundings can be eliminated or at least be considerably reduced.

At the same time, the known advantages of cleaning with sodium bicarbonate should be retained. The main advantages are the positive ecological properties of the material, its good cleaning action and solubility in water, and comparatively low health risk for the user. Moreover, appropriate choice of the pressure range allows the abrasive action of the material, which is in some cases hydrophobicized, to be influenced such that the structure of the surface to be cleaned remains undamaged.

SUMMARY OF THE INVENTION

The object of the present invention is achieved by the combination of sodium bicarbonate with polyaspartic acids and/or salts thereof in the cleaning composition. These and other features, aspects, and advantages of the present invention will become better understood with reference to the following description and appended claims.

DESCRIPTION OF THE INVENTION

The present invention provides cleaning compositions which, as powders or as aqueous formulations, comprise sodium bicarbonate and, as a dispersant, polyaspartic acids and/or salts thereof. The present invention further provides for the use of the novel cleaning composition for cleaning metallic and non-metallic surfaces and also a method of cleaning these surfaces.

The present invention is based on a remarkable discovery. Surprisingly, the addition of the polyaspartic acids and/or salts thereof as dispersants achieves, largely independently of other active ingredients in the abrasive cleaning formulations, a significantly increased soiling content in the waste water and a significant lowering in the sedimentation of detached particles than is the case for conventional compositions. In many cases, furthermore, a higher cleaning performance of the novel compositions has been observed.

By contrast, these effects could not be achieved through the sole use of polyaspartic acids and/or salts thereof with the exclusion of abrasive additives.

Finally, it has been found that the use of the compositions used according to the invention enables laborious cleaning of the surrounding area to be dispensed with, and only relatively small amounts of sedimented particles, which predominantly consist of sodium bicarbonate, if any, have to be sprayed off using a small amount of water.

The water-soluble carrier used according to the invention is sodium bicarbonate. Preference is given to using hydrophobicized sodium bicarbonate which ensures easier technical handling.

The particle size of the sodium bicarbonate is usually chosen such that, according to sieve analysis, between 10 and 70% by weight of the material have a particle size between 50$\mu$ and 300$\mu$, preferably between 170$\mu$ and 280$\mu$.

The content of sodium bicarbonate in the cleaning compositions is preferably from 20 to 95% by weight, in particular from 50 to 95% by weight.

The dispersants to be used according to the invention are polyaspartic acids and/or salts thereof.

Suitable polyaspartic acids are especially polyaspartic acid homopolymers and their salts, as described in WO 96/31 554, incorporated herein by reference in its entirety. Preference is given to using the sodium salt and the ammonium salt of polyaspartic acids, which are biodegradable and ecologically safe substances. It is of course also possible to use all other salts and/or water-soluble copolymers of polyaspartic acids and their salts. It is likewise possible to use the anhydride of polyaspartic acids, polysuccinimide (PSI).

The above-mentioned polyaspartic acids and/or derivatives thereof are present individually or in mixtures in amounts of at least 5% by weight. The sodium salt of the polyaspartic acids is preferably used in the cleaning compositions according to the invention in amounts between 5 and 12% by weight.

When the process of the invention is carried out in a dry process, the process can be carried out with compressed air. Alternatively, the dry process can be carried out without compressed air. When the process of the invention is carried out in a water jet process, the process can be carried out with compressed air. Alternatively, the water jet process can be carried out without compressed air.

Depending on the type of technical implementation, e.g., dry or water-jet processes, with or without compressed air, the cleaner formulations comprise greater or lesser amounts of water. Preference is given to choosing those cleaner formulations which have a low tendency of inhibiting the scatterability and flowability of the cleaning composition. The content of water can thus be chosen freely within wide limits.

In addition to the ingredients already mentioned, further additives may be present in the compositions. In this connection, particular mention may be made of dyes for characterising the respective cleaner formulation and preservatives. The content of such auxiliaries and additives is generally no greater than 10% by weight, and in most cases is considerably less than this.

In use, a cleaning composition containing a polyaspartic acid and/or a salt of a polyaspartic acid is applied to a hard surface, e.g., a metallic or non-metallic surface, such that the invention eliminates or considerably reduces the expenditure on post-treating and cleaning a hard surface and its surroundings. The invention undermines, dissolves, detaches or rubs down deposits from the hard surface, and disperses and stabilizes the soiling in an iso- and polydisperse manner as finely as possible. The invention largely suppresses sedimentation processes in the wash liquor in order to enable the liquor to be directly disposed with as high a soiling content as possible in an environmentally friendly manner, thereby satisfying desired application requirements with regard to dispersibility of the waste water. Further, the invention retains the advantages of cleaning with sodium bicarbonate, e.g., the positive ecological properties of the material, its good cleaning action and solubility in water, and comparatively low health risk for the user. Also, the invention allows a user to choose an appropriate pressure range when applying the composition such that the structure of the surface to be cleaned remains undamaged.

The invention is further described in the following illustrative examples in which all parts and percentages are by weight unless otherwise indicated.

EXAMPLES

A typical guide formulation for abrasive cleaning compositions according to the invention are given below. Abrasive cleaner formulation based on polyaspartic acids (Table 1)

| | |
|---|---|
| Sodium bicarbonate | 20 to 95% by weight |
| Polyaspartic acids, sodium salt | 5 to 15% by weight |
| Dyes | 0 to 1% by weight |
| Preservatives | 0 to 10% by weight |
| Water | to 100% by weight |

The novel cleaner formulations can be prepared in the simplest case by simply mixing all of the components in suitable dry-mixing units. In individual cases, however, it may be more appropriate to absorb the polyaspartic acids and/or derivatives thereof as aqueous dispersion on the carrier, or to process the carrier and the polyaspartic acids and/or derivatives thereof with water to give a suspension and then to introduce them in this form into the mixing unit.

The components given in Table 2 were mixed to give cleaning formulations 1 to 3. The contents in the table are given as percent by weight and are always based on the active ingredient content of the raw materials.

TABLE 2

| Example | 1 | 2 | 3 |
|---|---|---|---|
| Sodium bicarbonate | 90 | 0 | 95 |
| Polyaspartic acids, sodium salt | 8.8 | 88 | 0 |
| Acrylic acid homopolymer | 0 | 0 | 0 |
| Acrylic acid copolymer | 0 | 0 | 0 |
| Chelating agent | 0 | 0 | 0 |
| Surfactant | 0 | 0 | 0 |
| Dyes | 0.1 | 0 | 0 |
| Preservatives | 0 | 0.5 | 0 |
| Water | to 100 | to 100 | to 100 |

TESTING THE CLEANING EFFECT

In order to ensure that the individual mixtures according to Examples 1 to 3 were tested under conditions which as much as possible simulated those met in practice, a reactor from a chemical production plant was chosen which was uniformly contaminated with chemicals on the outside. The surface of the reactor top was divided into seven segments and each segment was labelled. On each reactor segment each of the cleaner formulations according to Examples 1 to 3, and the cleaning performance and the soil-carrying capacity of the waste water was assessed visually. Assessment was on the following scale:

1 uniform and complete cleaning without residues; or very good soil-carrying capacity 2 almost complete cleaning, only slight residues; or good soil-carrying capacity 3 visible, but only non-uniform, cleaning; or clear soil-carrying capacity 4 slight, but only non-uniform cleaning; or low soil-carrying capacity 5 no cleaning performance; or no soil-carrying capacity The results in Table 3 clearly show the better result with the novel compositions:

TABLE 3

| Example | 1 | 2 | 3 |
|---|---|---|---|
| Cleaning effect | 1 | 5 | 2 |
| Soil-carrying capacity | 1 | 5 | 4 |

While Example 2 in Table 3 gives entirely unsatisfactory performances both as regards the soil-carrying capacity and also as regards the cleaning effects, the cleaning effect in the case of Example 3 improves, whereas the soil-carrying capacity remains unsatisfactory. Example 1 gives the best results both in terms of the cleaning capacity and also as regards the soil-carrying capacity.

Although the present invention has been described in detail with reference to certain preferred versions thereof, other variations are possible. Therefore, the spirit and scope of the appended claims should not be limited to the description of the versions contained therein.

What is claimed is:

1. A method for cleaning a hard surface consisting of

A) applying, to a hard surface having a deposit, a cleaning composition consisting of (a) a sodium bicarbonate component, and (b) a dispersant component selected from the group consisting of polyaspartic acids, salts of polyaspartic acids, and polysuccinimide, and B) cleaning the hard surface.

2. The method of claim 1 wherein the step of applying the cleaning composition to the hard surface is done with a dry process.

3. The method of claim 1 wherein the step of applying the cleaning composition to the hard surface is done with a water jet process.

4. The method of 1, wherein the step of applying the cleaning composition to a hard surface includes applying the composition to a hard surface comprising a member selected from the group consisting of metal surfaces and non-metallic surfaces.

5. The method of claim 1, wherein the dispersant component is present in an amount that is at least 5% by weight.

6. The method of claim 1, wherein the dispersant component is present in an amount that is from 5 to 12% by weight.

7. The method of claim 2, wherein the step of applying the cleaning composition to the hard surface is carried out with compressed air.

8. The method of claim 2, wherein the step of applying the cleaning composition to the hard surface is carried out without compressed air.

9. The method of claim 3, wherein the step of applying the cleaning composition to the hard surface is carried out with compressed air.

10. The method of claim 3, wherein the step of applying the cleaning composition to the hard surface is carried out without compressed air.

11. A method for cleaning a hard surface consisting of

A) applying, to a hard surface having a deposit, a cleaning composition consisting of (a) a sodium bicarbonate component, and (b) a dispersant component selected from the group consisting of polyaspartic acids, salts of polyaspartic acids, and polysuccinimide, B) cleaning the hard surface, and C) removing the cleaning composition and deposits from the hard surface in a wash liquor and disposing of the wash liquor.

12. A method for cleaning a hard surface consisting of

A) applying, to a hard surface having a deposit, a cleaning composition consisting of (a) a sodium bicarbonate component, and (b) a dispersant component selected from the group consisting of polyaspartic acids, salts of polyaspartic acids, and polysuccinimide, B) cleaning the hard surface, and C) removing the cleaning composition and deposits from the hard surface.

* * * * *